United States Patent [19]

Otobe

[11] Patent Number: 4,572,129

[45] Date of Patent: Feb. 25, 1986

[54] AIR-FUEL RATIO FEEDBACK CONTROL METHOD FOR INTERNAL COMBUSTION ENGINES

[75] Inventor: Yutaka Otobe, Shiki, Japan

[73] Assignee: Honda Giken Kogyo K.K., Tokyo, Japan

[21] Appl. No.: 618,205

[22] Filed: Jun. 7, 1984

[30] Foreign Application Priority Data

Jun. 17, 1983 [JP] Japan ..... 58-108950

[51] Int. Cl.[4] ..... F02B 3/00

[52] U.S. Cl. ..... 123/440; 123/492; 123/493

[58] Field of Search ..... 123/440, 489, 339, 589, 123/492, 493

[56] References Cited

U.S. PATENT DOCUMENTS

| | | | |
|---|---|---|---|
| 4,187,812 | 2/1980 | Hosaka | 123/489 |
| 4,321,903 | 3/1982 | Kondo | 123/440 |
| 4,437,340 | 3/1984 | Csere | 123/440 |
| 4,466,410 | 8/1984 | Sakakibara | 123/440 |
| 4,470,395 | 9/1984 | Ohgami | 123/440 |

*Primary Examiner*—Ronald B. Cox

*Attorney, Agent, or Firm*—Arthur L. Lessler

[57] ABSTRACT

A method of controlling the air-fuel ratio of an air-fuel mixture being supplied to an internal combustion engine by the use of a coefficient which is variable in value in response to the output of an exhaust gas ingredient concentration detecting means, while the engine is operating in a predetermined air-fuel ratio feedback control region. When the engine is operating in the above region, a calculation is made of a mean value of values of the coefficient which have been applied in the past feedback control. When a transition occurs in the engine operation from a region other than the predetermined feedback control region to the latter region, the calculated mean value of the coefficient is corrected by a predetermined value through multiplication or addition, and the air-fuel ratio feedback control is initiated by the use of the corrected mean value of the coefficient as an initial value. Preferably, in an engine having an exhaust gas purifying device composed of a three-way catalyst arranged in the exhaust pipe, the mean value of the coefficient is corrected by the above predetermined value so that the resulting air-fuel ratio becomes richer than a theoretical ratio at the start of the air-fuel ratio feedback control.

5 Claims, 9 Drawing Figures

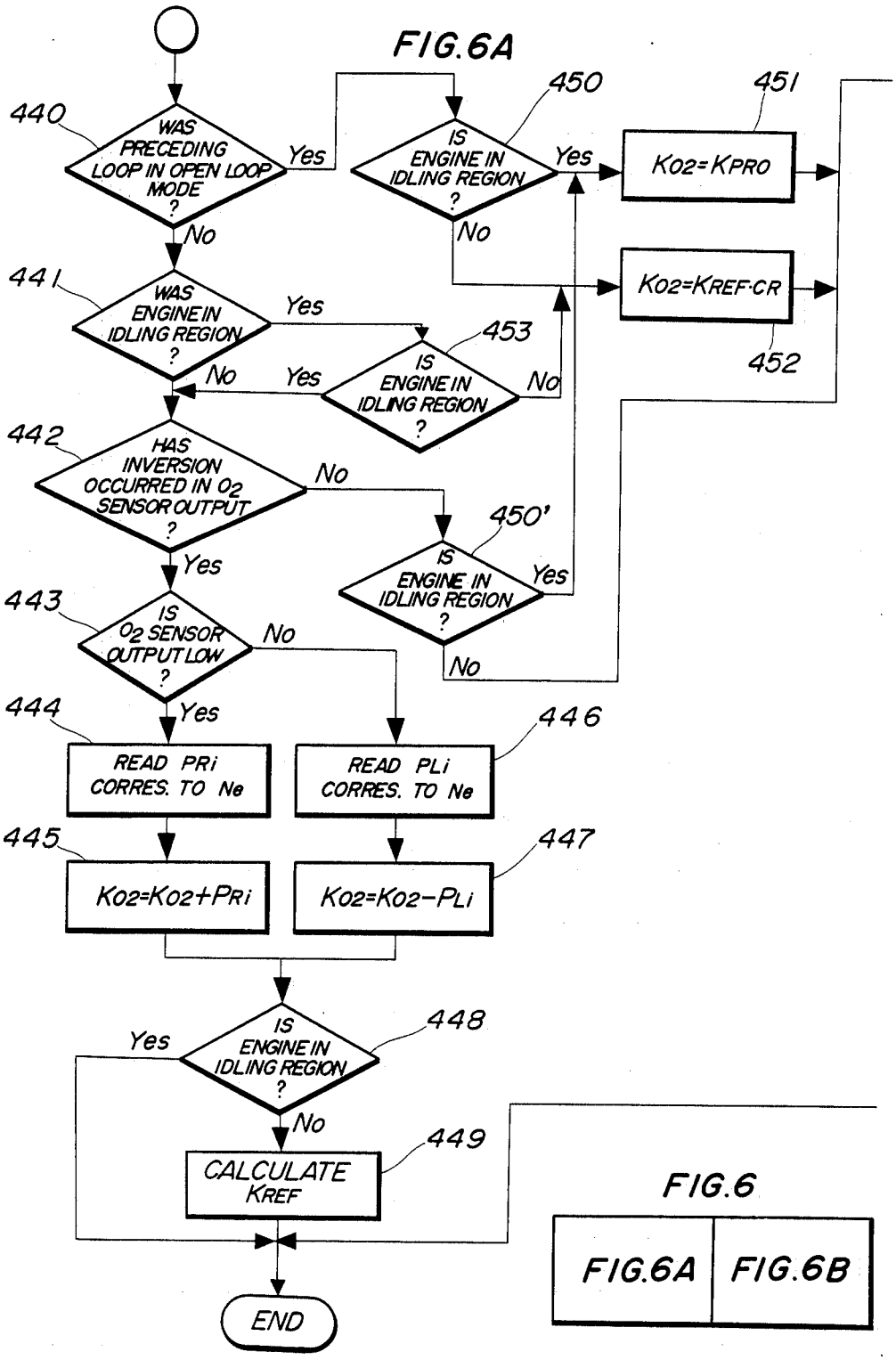
FIG.6A
440
WAS PRECEDING LOOP IN OPEN LOOP MODE ?
Yes
No
450
IS ENGINE IN IDLING REGION ?
Yes
No
451
KO2=KPRO
441
WAS ENGINE IN IDLING REGION ?
Yes
No
453
IS ENGINE IN IDLING REGION ?
Yes
No
KO2=KREF·CR
452
442
HAS INVERSION OCCURRED IN O2 SENSOR OUTPUT ?
No
Yes
450'
IS ENGINE IN IDLING REGION ?
Yes
No
443
IS O2 SENSOR OUTPUT LOW ?
No
Yes
444
READ PRi CORRES. TO Ne
446
READ PLi CORRES. TO Ne
445
KO2=KO2+PRi
447
KO2=KO2−PLi
448
IS ENGINE IN IDLING REGION ?
Yes
No
449
CALCULATE KREF
END
FIG.6
FIG.6A
FIG.6B

AIR-FUEL RATIO FEEDBACK CONTROL METHOD FOR INTERNAL COMBUSTION ENGINES

BACKGROUND OF THE INVENTION

This invention relates to a feedback control method of controlling the air-fuel ratio of an air-fuel mixture being supplied to an internal combustion engine, and more particularly to a method of this kind, which is applied at a transition of the engine operation from a region other than the feeback control region to the latter region.

A fuel supply control method for an internal combustion engine, particularly a gasoline engine, has been proposed, which is adapted to determine the valve opening period of a fuel injection device for control of the fuel injection quantity, i.e. the air-fuel ratio of an air-fuel mixture being supplied to the engine, by first determining a basic value of the above valve opening period as a function of engine speed and intake pipe absolute pressure and then adding to and/or multiplying same by variables and/or coefficients indicative of operating conditions of the engine, such as engine speed, intake pipe absolute pressure, engine temperature, throttle valve opening, exhaust gas ingredient concentration (oxygen concentration), etc, by electronic computing means.

According to this proposed method, while the engine is operating in a normal operating condition, the air-fuel ratio is controlled in closed loop or feedback mode such that the valve opening period of the fuel injection device is controlled by varying the value of a coefficient in response to the output of an exhaust gas ingredient concentration detecting means which is arranged in the exhaust system of the engine, so as to attain a theoretical air/fuel ratio of a value close thereto (closed loop control), whereas while the engine is operating in one of particular operating conditions (e.g. a mixture-leaning region, a wide-open-throttle region, and a fuel-cut effecting region), the air-fuel ratio is controlled in open loop mode by the use of a mean value of values of the above coefficient applied during the preceding feedback control, together with an exclusive coefficient corresponding to the kind of the particular operating region in which the engine is then operating, thereby preventing deviation of the air-fuel ratio from a desired air-fuel ratio due to variations in the performance of various engine operating condition sensors and a system for controlling or driving the fuel injection device, etc., which are caused by machining tolerances or the like and/or due to aging changes in the performance of the sensors and the system, and also achieving required air-fuel ratios best suited for the respective particular operating conditions, to thus reduce the fuel consumption as well as improve the driveability of the engine.

However, according to this method, when a transition occurs in the engine operation from one of the above particular operating regions wherein the air-fuel ratio is controlled in open loop mode of the feedback control region, the feedback control is initiated by the use of a mean value of values of the above feedback control correction coefficient applied during the past feedback control. As a result, there exists a time lag in controlling air-fuel ratio to a desired value until the above feedback control correction coefficient assumes a value appropriate for attaining desired emission characteristics during the feedback control. Therefore, if the method is applied to an internal combustion engine having an exhaust gas purifying device, such as a three-way catalyst, until a period of time corresponding to the above time lag elapses, the amount of exhaust gas ingredient NOx can increase if the air-fuel ratio varies from a leaner value to the appropriate value, whereas the amounts of ingredients CO, UHC, etc. in the exhaust gases can increase if the air-fuel ratio varies from a richer value to the above appropriate value.

SUMMARY OF THE INVENTION

It is the object of the invention to provide an air-fuel ratio feedback control method for an internal combustion engine, which is adapted to set the initial air-fuel ratio of an air-fuel mixture being supplied to the engine to such values that can positively reduce noxious ingredients in the exhaust gases, such as NOx, CO and UHC, at the start of the air-fuel ratio feedback control, thereby eliminating the aforementioned time lag in the air-fuel ratio feedback control in the case of applying a mean value of the feedback control correction coefficient as an initial coefficient value at the start of the air-fuel ratio feedback control.

The present invention provides a method of effecting feedback control of controlling the air-fuel ratio of an air-fuel mixture being supplied to an internal combustion engine, by the use of a coefficient which is variable in value in response to the output of an exhaust gas ingredient concentration detecting means arranged in the exhaust pipe of the engine, while the engine is operating in a predetermined air-fuel ratio feedback control region. The method is characterized by comprising the following steps: (1) determining whether or not the engine is operating in the predetermined air-fuel ratio feedback control region; (2) calculating a mean value of values of the coefficient which have been applied in the past feedback control, when the engine is operating in the predetermined air-fuel ratio feedback control region; (3) correcting the calculated mean value of the coefficient obtained at the step (2) by a predetermined value when a transition occurs in the engine operation from a region other than the predetermined air-fuel ratio feedback control region to the latter region; and (4) initiating the air-fuel ratio feedback control by the use of the corrected mean value of the coefficient as an initial value.

In an internal combustion engine having a three-way catalyst as an exhaust gas purifying device arranged in the exhaust pipe at a location downstream of the exhaust gas ingredient concentration detecting means, if it is intended to reduce the amount of NOx in the exhaust gases, the mean value of the coefficient is corrected by the predetermined value so that the resulting air-fuel ratio is richer than a theoretical air-fuel ratio at the start of the air-fuel ratio feedback control.

Preferably, the correction of the mean value of the coefficient of the step (3) comprises multiplying the mean value by the predetermined value, or adding the predetermined value to the mean value.

The above and other objects, features and advantages of the invention will be more apparent from the ensuing detailed description taken in conjunction with the accompanying drawings.

BRIEF DESCRIPTION OF THE DRAWINGS

FIGS. 6, 6A and 6B are flowcharts showing in detail the step 44 in FIG. 3, in which is executed a subroutine for calculating the value of a correction coefficient $KO_2$ applied at engine operation in the air-fuel ratio feedback control region; and FIG. 7 is part of a flowchart of another example of the subroutine for calculating the value of correction coefficient $KO_2$, as another example of the step 452 in FIG. 6.

DETAILED DESCRIPTION

The invention will now be described in detail with reference to the drawings.

Figure 1:
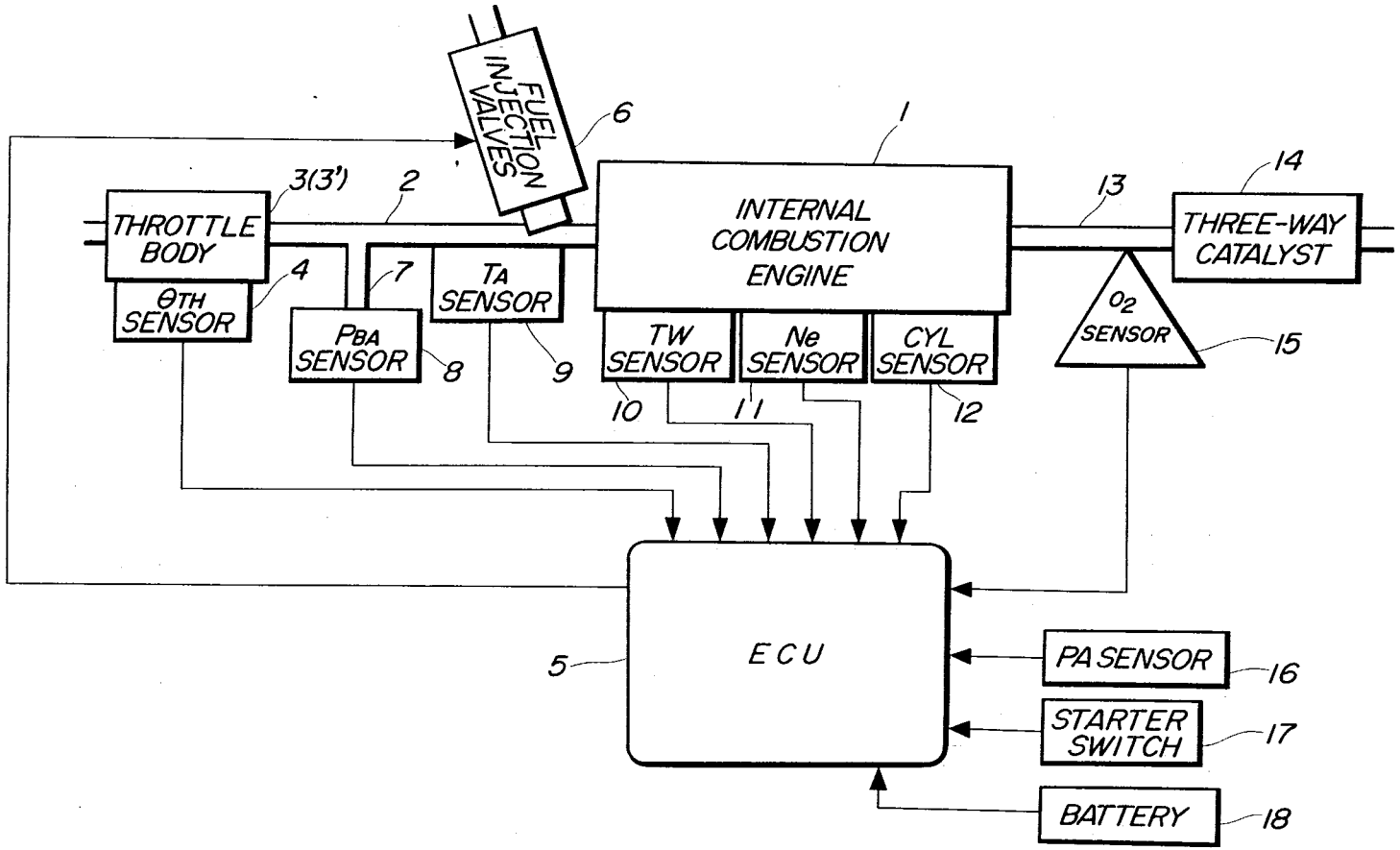
FIG. 1 is a block diagram illustrating the whole arrangement of a fuel supply control system to which is applicable the method according to the invention.

Referring first to FIG. 1, there is illustrated the whole arrangement of a fuel supply control system for internal combustion engines, to which the method of the invention is applicable. Reference numeral 1 designates an internal combustion engine which may be a four-cylinder type, for instance. An intake pipe 2 is connected to the engine 1, in which is arranged a throttle body 3 accommodating a throttle valve 3', which in turn is coupled a throttle valve opening ($\theta$TH) sensor 4 for detecting its valve opening and converting same into an electrical signal which is supplied to an electronic control unit (thereinafter called "the ECU") 5.

Fuel injection valves 6 are arranged in the intake pipe 2 at a location between the engine 1 and the throttle valve 3', which correspond in number to the engine cylinders and are each arranged at a location slightly upstream of an intake valve, not shown, of a corresponding engine cylinder. These injection valves 6 are connected to a fuel pump, not shown, and also electrically connected to the ECU 5 in a manner having their valve opening periods or fuel injection quantities controlled by signals supplied from the ECU 5.

On the other hand, an absolute pressure (PBA) sensor 8 is arranged in communication through a conduit 7 with the interior of the intake pipe 2 at a location downstream of the throttle valve 3'. The absolute pressure (PBA) sensor 8 is adapted to detect absolute pressure in the intake pipe 2 and applies an electrical signal indicative of detected absolute pressure to the ECU 5. An intake air temperature (TA) sensor 9 is arranged in the intake pipe 2 at a location downstream of the absolute pressure (PBA) sensor 8 and also electrically connected to the ECU 5 for supplying thereto an electrical signal indicative of detected intake air temperature.

An engine temperature (TW) sensor 10, which may be formed of a thermistor or the like, is mounted on the cylinder block of the engine 1 in a manner embedded in the peripheral wall of an engine cylinder having its interior formed with a cooling water jacket, an electrical output signal of which is supplied to the ECU 5.

An engine rotational angle position (Ne) sensor 11 and a cylinder-discriminating (CYL) sensor 12 are arranged in facing relation to a camshaft, not shown, of the engine 1 or a crankshaft of same, not shown. The former 11 is adapted to generate one pulse at each of particular crank angles of the engine each time the engine crankshaft rotates through 180 degrees, i.e. upon generation of each pulse of a top-dead-center position (TDC) signal, while the latter 12 is adapted to generate one pulse at a particular crank angle of a particular engine cylinder. The above pulses generated by the sensors 11, 12 are supplied to the ECU 5.

A three-way catalyst 14 is arranged in an exhaust pipe 13 extending from the main body of the engine 1 for purifying ingredients HC, CO and NOx contained in the exhaust gases. An $O_2$ sensor 15 is inserted in the exhaust pipe 13 at a location upstream of the three-way catalyst 14 for detecting the concentration of oxygen in the exhaust gases and supplying an electrical signal indicative of a detected concentration value to the ECU 5.

Further connected to the ECU 5 are a sensor 16 for detecting atmospheric pressure and a starter switch 17 for actuating the engine starter, not shown, of the engine 1, respectively, for supplying an electrical signal indicative of detected atmospheric pressure and an electrical signal indicative of its own on and off positions to the ECU 5.

Further electrically connected to the ECU 5 is a battery 18 which supplies the ECU 5 with a supply voltage for operating the ECU 5.

The ECU 5 operates in response to various engine operation parameter signals as stated above, to determine operating conditions in which the engine is operating, such as a predetermined air-fuel ratio feedback control region and particular operating regions (open loop mode control regions, hereinafter referred to), and to calculate the fuel injection period TOUT for which the fuel injection valves 6 should be opened, in accordance with the determined operating conditions of the engine and in synchronism with generation of pulses at the TDC signal, by the use of the following equation:

$$TOUT = Ti \times (KTA \times KTW \times KWOT \times KLS \times KDR \times KCAT \times KO_2) + (TV + \Delta TV) \quad (I)$$

where Ti represents a basic value of the valve opening period or fuel injection period of the fuel injection valves 6, which is determined as a function of engine speed Ne and intake pipe absolute pressure PBA, and KTA an intake air temperature-dependent correction coefficient and KTW an engine temperature-dependent correction coefficient, which have their values determined by intake air temperature TA and engine cooling water temperature TW, respectively. KWOT, KLS and KDR are correction coefficients, of which KWOT is a mixture-enriching coefficient applicable at wide-open-throttle operation, KLS a mixture-leaning coefficient applicable at mixture-leaning operation, and KDR a mixture-enriching coefficient applicable at operation of the engine in a low engine speed open loop control region which the engine passes while it is being rapidly accelerated from the idling region, for the purpose of improving the driveability of the engine in such operating condition. KCAT is a mixture-enriching coefficient applicable at engine operation in a high engine speed open loop control region, for the purpose of preventing buring of the three-way catalyt 14 in FIG. 1. This coefficient KCAT is set to larger values at the engine load increases. $KO_2$ represents an $O_2$ sensor output-dependent correction coefficient, the value of which is determined in response to the oxygen concentration in the exhaust gases during engine operation in the feedback control region, in a manner shown in FIG. 3. On the other hand, this correction coefficient $KO_2$ has its value set to and held at respective predetermined values during engine operation in other or particular operating conditions wherein the feedback control is not effected. TV and ΔTV represent, respectively, a variable and a correction variable, which have their values determined in response to the output voltage from the battery 18.

The ECU 5 operates on the value of the fuel injection period TOUT determined as above to supply corresponding driving signals to the fuel injection valves 6.

Figure 2:
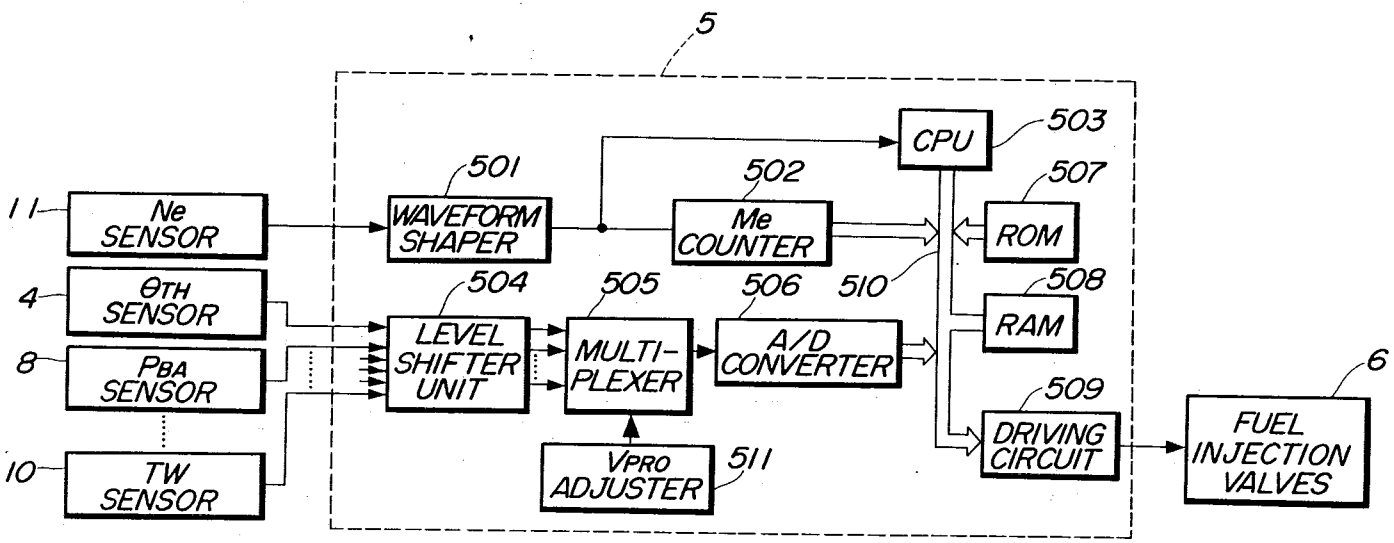
FIG. 2 is a block diagram illustrating the internal arrangement of an electronic control unit (ECU) appearing in FIG. 1.

FIG. 2 shows a circuit configuration within the ECU 5 in FIG. 1. An output signal from the engine rotational angle position (Ne) sensor 11 is applied to a waveform shaper 501, wherein it has its pulse waveform shaped, and supplied to a central processing unit (hereinafter called "the CPU") 503, as the TDC signal, as well as to an Me value counter 502. The Me value counter 502 counts the interval of time between a preceding pulse of the TDC signal generated at a predetermined crank angle of the engine and a present pulse of the same signal generated at the same crank angle, inputted thereto from the engine rotational angle position (Ne) sensor 11, and therefore its counted value Me is proportional to the reciprocal of the actual engine speed Me. The Me value counter 502 supplies the counted value Me to the CPU 503 via a data bus 510.

The respective output signals from the throttle valve opening (θTH) sensor 4, the intake pipe absolute pressure (PBA) sensor 8, the engine coolant temperature (TW) sensor 10, etc. have their voltage levels shifted to a predetermined voltage level by a level shifter unit 504 and then successively applied to an analog-to-digital converter 506 through a multiplexer 505.

Connected to the multiplexer 505 is a VPRO value adjuster 511 which comprises a variable voltage supply circuit formed of voltage dividing resistances or the like and, preferably, connected to a constant voltage-regulator circuit, not shown. The VPRO value adjuster 511 supplies the analog-to-digital converter 506 through the multiplexer 505 with an adjusted voltage VPRO which determines the value of a correction coefficient KPRO applied during engine operation in certain particular operating regions, as hereinafter described. The analog-to-digital converter 506 successively converts into digital signals analog output voltages from the aforementioned various sensors and the VPRO value adjuster 511, and the resulting digital signals are supplied to the CPU 503 via the data bus 510.

Further connected to the CPU 503 via the data bus 510 are a read-only memory (hereinafter called "the ROM") 507, a random access memory (hereinafter called "the RAM") 508 and a driving circuit 509. The RAM 508 temporarily stores various calculated values from the CPU 503, while the ROM 507 stores a control program executed within the CPU 503, a map of the basic fuel injection period Ti for the fuel injection values 6, which has its values read in dependence on intake pipe absolute pressure and engine speed, correction coefficient maps, etc.

The CPU 503 executes the control program stored in the ROM 507 to calculate the fuel injection period TOUT for the fuel injection valves 6 in response to the various engine operation parameter signals and the parameter signals for correction of the fuel injection period, and supplies the calculated value of fuel injection period to the driving circuit 509 through the data bus 510. The driving circuit 509 supplies driving signals corresponding to the above calculated TOUT value to the fuel injection valves 6 to drive same.

Figure 3:
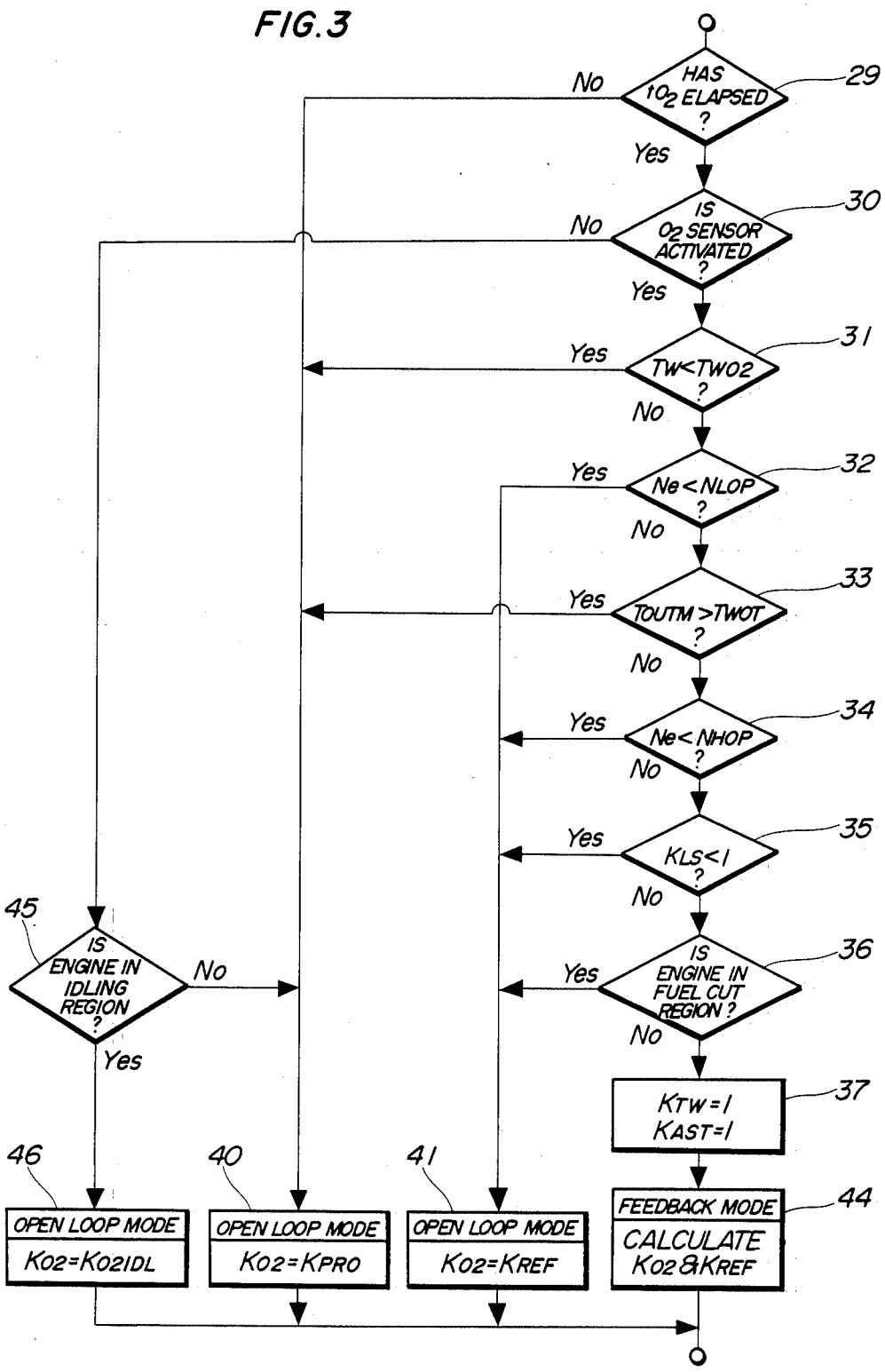
FIG. 3 is a flowchart of a manner of executing the method according to the invention.

Referring next to FIG. 3, there is shown a flowchart of a program for carrying out the method according to the invention. This program is executed upon generation of each pulse of the TDC signal. First, at the step 29, it is determined whether or not a predetermined period of time $tO_2$, e.g. 5 seconds, has elapsed since an ignition switch, not shown, of the engine was turned on. If the answer is no, the correction coefficient $KO_2$ has its value set to a value KPRO hereinafter referred to, at the step 40, for controlling the air-fuel ratio in open loop mode. If the answer is yes, a determination is made as to whether or not the $O_2$ sensor has become activated, at the step 30. If the answer to the question at the step 30 is no, that is, when the $O_2$ sensor has not yet become activated, it is determined, at the step 45, whether or not the engine is operating in the idling region, which is indicated by the symbol VI in FIG. 4.

Figure 4:
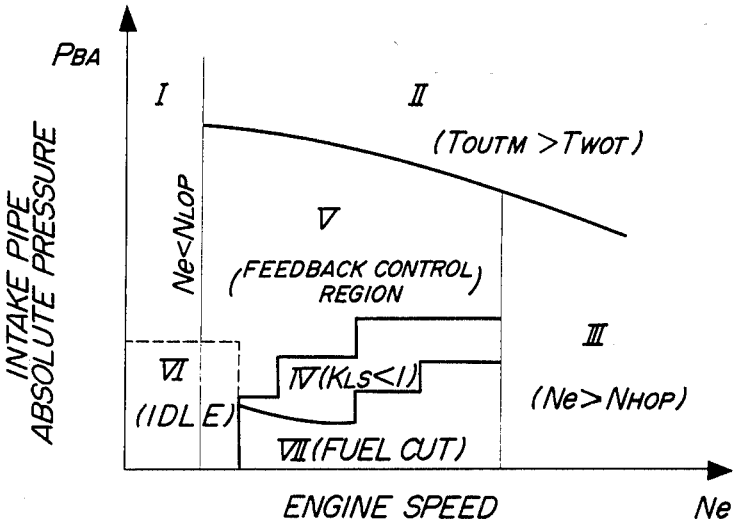
FIG. 4 is a graph showing various operating regions of the engine.
Figure 5:
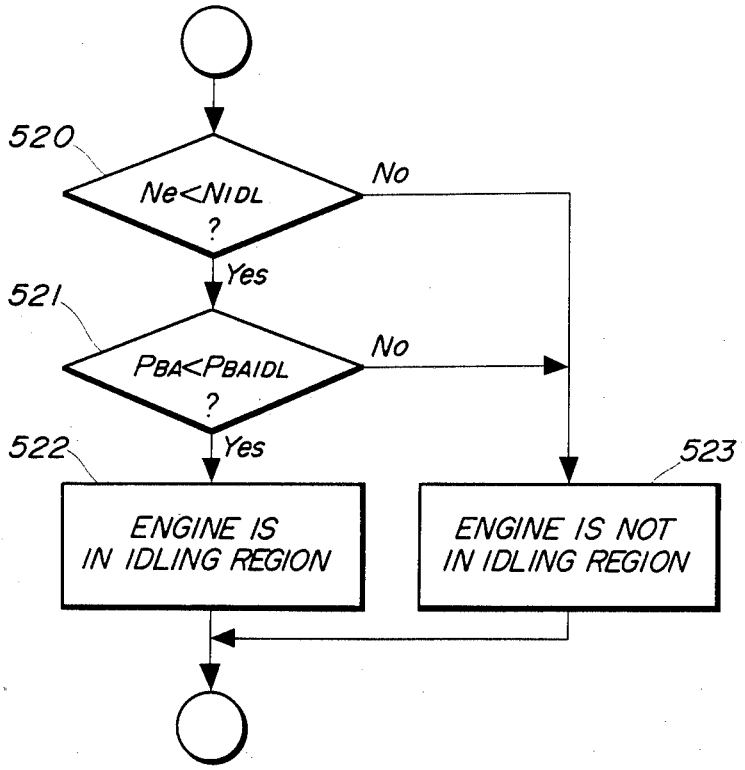
FIG. 5 is a flowchart of a subroutine for determining an idling region of the engine.

The determination as to whether or not the engine is operating in the idling region is effected in a manner as shown in FIG. 5. That is, it is first determined, at the step 520, whether or not the engine rotational speed Ne is lower than an idling speed NIDL, e.g. 1000 rpm, and if the answer is yes, a determination is made as to whether or not the intake pipe abolute pressure PBA is lower than a value PBAIDL, e.g. 350 mm Hg, which is assumed when the engine is operating in the idling region, at the step 521. If the answer to the question at the step 521 is yes, the engine is determined to be operating in the idling region, i.e. the region indicated by the symbol VI in FIG. 4, at the step 522. If either of the determinations at the steps 520 and 521 provides a negative answer (no), the engine is determined to be operating in a region other than the idling region, at the step 523.

Reverting to FIG. 3, if the answer to the question at the step 45 is no, the air-fuel ratio correction coefficient $KO_2$ has it value set to the aforementioned value KPRO, at the step 40. This KPRO value is applied at operation of the engine in particular operating regions, i.e. at deactivation of the $O_2$ sensor, at a low engine cooling water temperature, and at a large engine load, alone or together with a coefficient proper to the particular operating region applied. The KPRO value is set to such a value that the resulting air-fuel ratio assumes a value best suited to each of the above particular operating regions of the engine, and is normally set to 1.0 or a value close thereto.

One might consider employing, in lieu of the above KPRO value, a mean value KREF of the correction coefficient $KO_2$, which has been calculated during the preceding feedback control, to be applied at engine operation in the aformentioned particular operating regions. However, the operating conditions of the engine assumed in the above particular operating regions are considerably different from that assumed in the feedback control region. Therefore, if the mean value KREF is directly applied at engine operation in the particular operating regions for control of the air-fuel ratio, there is a possibility that the resulting air-fuel ratio assumes a value largely deviated from the respective required values for the particular engine operating regions.

For the above reasons, the KPRO value is employed as a value of the correction coefficient $KO_2$ when the engine is operating in any of the above particular operating regions. The value of the coefficient KPRO is determined for each lot of engines on the production line so that it can achieve desired air-fuel ratios which enable attainment of optimum operating characteristics of each engine such as driveability, emission characteristics and fuel consumption during operation of the engine in the above particular operating regions, and then the output voltage VPRO from the VPRO value adjuster 511 in FIG. 2 is adjusted by selecting the value of a resistance of the VPRO value adjuster 511 at a value corresponding to the value of the coefficient KPRO thus determined.

In addition, the KPRO value is set to an appropriate value through adjustment of the VPRO value adjuster 511 in the ECU 5 in a fuel supply control system employing the method of the invention when the same control system is mounted onto an engine, so as to be used as an initial value of the mean value KREF of the coefficient $KO_2$. This is because the mean value KREF is obtained on the basis of values of the coefficient $KO_2$ applied during past operation of the engine and therefore not yet obtained at the shipment of the engine.

If the answer to the question at the step 45 is yes, that is, when the engine is operating in the idling region, the correction coefficient $KO_2$ has its vaLue set to a value $KO_2IDL$, at the step 46, and then the air-fuel ratio of the mixture is controlled in open loop mode. This $KO_2IDL$ value is set at such a value that the resulting air-fuel ratio is slightly richer than the theoretical ratio.

If the answer to the question at the step 30 is yes, that is, when the $O_2$ sensor has completed activation, it is determined whether or not the engine is operating in the feedback control region wherein the air-fuel ratio of the mixture is controlled in feedback mode in response to the output of the $O_2$ sensor, at the following steps. That is, at the step 31, a determination is made as to whether or not the engine cooling water temperature TW is lower than a predetermined value $TWO_2$, e.g. 70° C., and when the answer is yes, the program proceeds to the step 40, while when the answer is no, the step 32 is executed.

The reason for determining whether or not the engine water temperature TW is lower than the predetermined value $TWO_2$ at the step 31 is as follows: Even when it is determined at the step 30 that the activation of the $O_2$ sensor is completed, the temperature TW of the engine cooling water can be lower than the above predetermined value $TWO_2$, and on such occasion, the air-fuel ratio of the mixture should not be controlled in feedback mode, but in open loop mode, so as to promptly warm up the engine.

It is determined at the step 32 whether or not the engine is operating in the low engine speed open loop control region, indicated by the symbol I in FIG. 4. If the answer is yes, that is, when the engine speed Ne is lower than a predetermined value NLOP, e.g. 600 rpm, and at the same time the intake pipe abolute pressure PBA is higher than the aforementioned value PBAIDL, the correction coefficient $KO_2$ has its value set to the mean value KREF of the same coefficient, at the step 41.

If the answer to the question at the step 32 is no, it is determined whether or not the fuel injection period TOUT is longer than a predetermined period TWOT, e.g. 14.0 ms, at the step 33. This determination is made to determine whether or not the engine is operating in the wide-open-throttle region, indicated by the symbol II in FIG. 4. If the answer is yes, the program proceeds to the step 40 wherein the correction coefficient $KO_2$ has its value set to the aforementioned value KPRO, while if the answer is no, it is determined at the step 34 whether or not the engine is operating in the high engine speed open loop control region, indicated by the symbol III in FIG. 4. That is, at the step 34, a determination is made as to whether or not the engine speed Ne is higher than a predetermined value NHOP, e.g. 3000 rpm. If the answer is yes, the program proceeds to the aforementioned step 41, while if the answer is no, it is determined, at the step 35, whether or not the value of the mixture-leaning correction coefficient KLS is smaller than 1 (i.e. $KLS<1$), in other words, it is determined whether or not the engine is operating in the mixture-leaning region, i.e. the region indicated by the symbol IV in FIG. 4, which is determined in dependence on the engine speed Ne and the intake pipe absolute pressure PBA.

If the answer to the question at the step 35 is yes, the step 41 is executed to set the value of the coefficient $KO_2$ to the aforementioned value KREF. On the other hand, if the answer is no, it is determined at the step 36 whether or not the engine is operating in the fuel-cut effecting region, i.e. the region indicated by the symbol VII in FIG. 4. At this step 36, if the engine speed Ne is lower than a predetermined value NFC, e.g. 2000 rpm, the engine is determined to be operating in the fuel-cut effecting region, on condition that the throttle valve opening $\eta TH$ shows a substantially fully closed position. On the other hand, if the engine speed Ne is higher than the predetermined value NFC, the engine is determined to be in the fuel-cut effecting region, on condition that the intake pipe abolute pressure PBA is lower than a predetermined value PBAFCj which is set to larger values as the engine speed Ne increases. If the determination at the step 36 provides an affirmative answer (yes), that is, when the engine is operating in the fuel-cut effecting region, the program proceeds to the step 41. If the answer is no, it is judged that the engine is operating in the air-fuel ratio feedback control region, i.e. the region indicated by the symbol V in FIG. 4, wherein the air-fuel ratio mixture is controlled in response to the output of the $O_2$ sensor 15. Therefore, on this occasion the engine temperature-dependent correction coefficient KTW and a fuel-increasing coefficient KAST applicable after the start of the engine are both set to 1, at the step 37, and then calculations are made of the value of the air-fuel ratio correction coefficient $KO_2$ and the mean value KREF of the same coefficient, at the step 44.

In this manner, the engine is determined to be operating in the air-fuel ratio feedback control region when all the determinations at the steps 31 through 36 provide answers satisfying the feedback control condition after the completion of activation of the $O_2$ sensor 15. When the air-fuel ratio feedback control is initiated, correction coefficients such as the engine temperature-dependent correction coefficient KTW and the fuel-increasing coefficient KAST are necessarily set to 1 even if they then assume values larger than 1, as stated before. Therefore, fuel corrections, i.e. engine temperature-dependent correction of fuel by the use of the coefficient KTW and fuel increment correction after the start of the engine by the use of the coefficient KAST, are not effected in this air-fuel ratio feedback control.

Calculation of the correction coefficient $KO_2$ at the step 44 in FIG. 3 is carried out in a manner shown in the flow chart of FIG. 6.

First, it is determined whether or not the preceding loop was executed in open loop mode, at the step 440. If the answer is no, a determination is made as to whether or not the engine was operating in the idling region at the time of execution of the preceding loop, at the step 441. If the answer to the question at the step 441 is no, the program proceeds to the step 442 to determine whether or not the output of the $O_2$ sensor 15 has been inverted after the execution of the preceding loop.

If the answer to the question at the step 440 is yes, that is, when the preceding loop was executed in open loop mode, it is determined whether or not the engine is operating in the idling region at the present loop, at the step 450. If the answer is yes, the correction coefficient $KO_2$ has its value set to the value KPRO, at the step 451, and then the newly set coefficient $KO_2$ value is employed as an initial value in the following integral control which is executed at the steps 454 et seq.

If the answer to the question at the step 450 is no, the correction coefficient $KO_2$ has its value set to a value KREF.CR, hereinafter referred to, at the step 452, and then the integral control is effected at the steps 454 et seq., employing the coefficient $KO_2$ value thus determined as an initial value. The value CR is set to such a value that the overall emission characteristics of the engine are improved over the whole engine operating regions, depending upon the emission characteristics of the engine per se, the exhaust gas purifying characteristics of the exhaust gas purifying device, etc. More specifically, if it is intended to reduce the amount of exhaust gas ingredient NOx, for instance, the value CR is set at a value larger than 1 so that the air-fuel ratio of the mixture, which is controlled by the correction coefficient $KO_2$ value, assumes a value richer than the theoretical ratio without fail. On the other hand, if it is intended to reduce the amounts of ingredients CO, UHC in the exhaust gases, the value CR is set at a value smaller than 1 so that the resulting air-fuel ratio becomes leaner than the theoretical ratio without fail. If the answer to the question at the step 441 is yes, that is, when the engine was operating in the idling region at the time of execution of the preceding loop, it is determined at the step 453 whether or not the engine is operating in the idling region in the present loop. If the answer is yes, the program proceeds to the aforementioned step 442, while if the answer is no, the aforementioned step 452 is executed. That is, when the oprating condition of the engine changes from the idling region, i.e. the region indicated by the symbol VI in FIG. 4, to the feedback control region, i.e. the region indicated by the symbol V in FIG. 4, the initial value of the coefficient $KO_2$ is set to a value equal to the product of the values KREF and CR, at the start of the air-fuel ratio feedback control.

If the answer to the question at the step 442 is no, it is determined at the step 450' whether or not the engine is operating in the idling region in the present loop. If the answer is yes, that is, when the engine operating condition changes from the feedback control region (i.e. the region indicated by the symbol V in FIG. 4) to the idling region (i.e. the region indicated by the symbol VI in FIG. 4), in a manner reverse to the above case, the coefficient $KO_2$has its value set to the value KPRO and the feedback control is effected by the use of the KPRO value. Variations in the mean value of $KO_2$ values between engines in different lots on the production line are more conspicuous if the mean value is obtained during feedback control in the idling region than if it is obtained during feedback control in a region other than the idling region. Therefore, after transition from the feedback control region to the idling region, the KPRO value, which is adjusted by means of the VPRO value adjuster 511 for each lot of engines, is used at the start of the feedback control. If the answer to the question at the step 450' is no, the program executes the following steps 454 et seq. to effect the integral control.

If the answer to the question at the step 442 is yes, a proportional control or P-term control of the correction coefficient $KO_2$ is carried out in the following steps. That is, first at the step 443, a determination is made as to whether or not the output of the $O_2$ sensor has a low level with respect to a reference value. If the answer is yes, a correction value PRi corresponding to the engine speed Ne is read from an Ne-PRi table, at the step 444, and the correction value PRi thus obtained is added to the value of the correction coefficient $KO_2$, at the step 445, followed by a determination at the step 448 as to whether or not the engine is operating in the idling region. If the answer to the question at the step 443 is no, a correction value PLi corresponding to the engine speed Ne is read from an Ne-PLi table, at the step 446, and then the correction value PLi is subtracted from the value of the correction coefficient $KO_2$, at the step 447, followed by execution of the step 448.

If the answer to the question at the step 448 is no, a mean value KREF of the correction coefficient $KO_2$ is calculated, at the step 449, while if the answer is yes, the calculation of the mean value KREF is not carried out, thus keeping the mean value KREF from being updated during engine operation in the idling region. As noted above, when an inversion occurs in the output of the $O_2$ sensor, the correction value PRi or PLi is added to or subtracted from the value of the correction coefficient $KO_2$, in such a manner as to compensate for the inversion of the output of the $O_2$ sensor.

At the step 449, the mean value KREF is calculated by the use of the correction coefficient $KO_2$ value thus obtained, according to the following equation, and the calculated KREF value is stored in a memory in the ECU 5:

$$KREF = KO_2P \times (CREF/A) + KREF' \times (A - CREF)/A \quad (2)$$

where $KO_2P$ represents a value of the coefficient $KO_2$ obtained immediately after execution of the P-term control, A a constant, CREF a variable experimentally obtained, which is set at an appropriate value between 1 and A, and KREF' a mean value of values of the correction coefficient $KO_2$ obtained so far through past operation of the engine, respectively. Incidentally, at the shipment of engines, the aforementioned KPRO value is employed as an initial value for the KREF' value, as stated before.

Since the ratio between the values of $KO_2P$ and KREF' assumed in each execution of the P-term control is dependent on the variable CREF, it is possible to obtain a most appropriate KREF value by setting the CREF value at such a value between 1 and A that best suits the type of an air-fuel ratio feedback control system, an engine, etc., to be applied.

The integral control of the steps 454 et seq. is carried out as follows: First, at the step 454, it is determined whether or not the output of the $O_2$ sensor has a lower level with respect to the reference value. When the output of the $O_2$ sensor has such low level, 1 is added to a control variable niL, at the step 455, and then a determination is made as to whether or not the control variable niL has reached a predetermined value ni, at the step 456. If the answer to the question at the step 456 is no, the value of the correction coeffificient $KO_2$ is held at its immediately preceding value, at the step 459, while if the answer is yes, a predetermined value Δ is added to the value of the coefficient $KO_2$, at the step 457, and the control variable niL is reset to zero, at the step 458. When the steps 455 through 459 are repeatedly executed, the predetermined value Δ is added to the $KO_2$ value each time the control variable niL reaches the predetermined value ni.

If the answer to the question at the step 454 is no, that is, when the output of the $O_2$ sensor has a higher level with respect to the reference value, 1 is added to a control variable niH, at the step 460, and then it is determined whether or not the control variable niH has reached the predetermined value ni, at the step 461. If the answer to the question at the step 461 is no, the value of the correction coefficient $KO_2$ is held at its immediately preceding value, at the step 464, while if the answer is yes, the predetermined value Δ is subtracted from the coefficient $KO_2$ value, at the step 462, and then the control varible niH is reset to zero, at the step 463. When the steps 461 through 464 are repeatedly executed, the predetermined value Δ is subtracted from the $KO_2$ value each time the control variable niH reaches the predetermined value ni.

In this manner, when the output of the $O_2$ sensor maintains a lower level or a higher level with respect to the reference value, the predetermined value Δ is added to or subtracted from the correction coefficient $KO_2$ value each time the number of pulses of the TDC signal reaches the predetermined value ni, in such a manner as to compensate for the low or high level of the output of the $O_2$ sensor.

Figures 6B, 7:
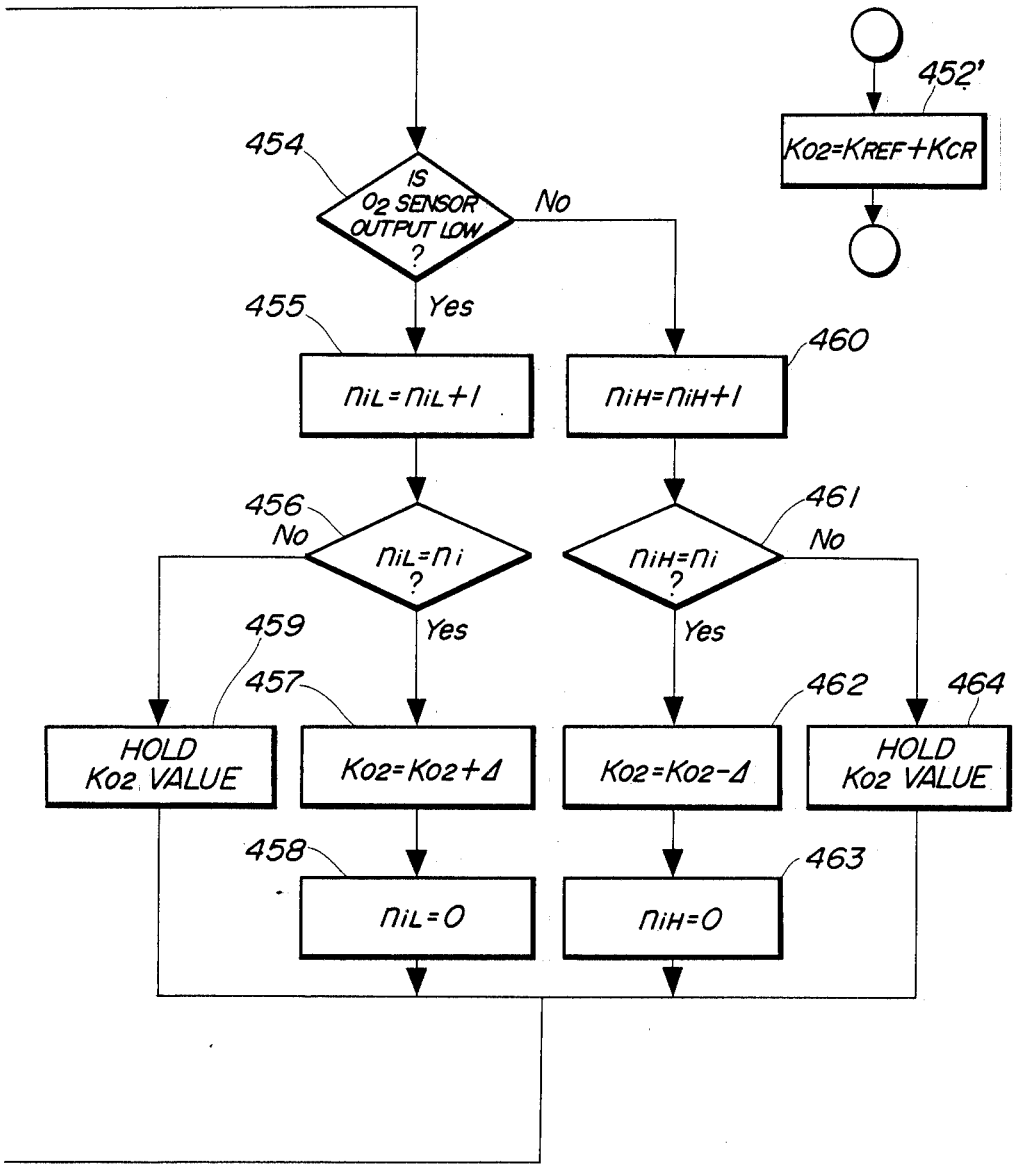

Although, in the step 452 of FIG. 6, an initial value of the coefficient $KO_2$ is obtained through multiplication of the mean value KREF by the value CR, the initial value may alternatively be obtained in a manner shown in the step 452' of FIG. 7, with substantially the same results as above. On this occasion, a constant KCR is added to the mean value KREF to obtain the $KO_2$ value. If it is desired to reduce the amount of exhaust gas ingredient NOx, the constant KCR is set at a value of 0.2, for instance, while if it is desired to reduce the amounts of ingredients CO, etc. in the exhaust gases, the constant KCR is set at a value of −0.2, for instance.

What is claimed is:

1. A method of effecting feedback control of the air-fuel ratio of an air-fuel mixture being supplied to an internal combustion engine having an exhaust pipe and an exhaust gas ingredient concentration detecting means arranged in said exhaust pipe, by correcting a basic value of fuel supply quantity by the use of a coefficient variable in value in response to the output of said exhaust gas ingredient concentration detecting means, while said engine is operating in a predetermined air-fuel ratio feedback control region other than an idling region, the method comprising the steps of:

(1) determining whether or not said engine is operating in said predetermined air-fuel ratio feedback control region;

(2) calculating a mean value of values of said coefficient which have been applied in said feedback control, when said engine is operating in said predetermined air-fuel ratio feedback control region;

(3) correcting the calculated mean value of said coefficient obtained at said step (2) by a predetermined value immediately when a transition occurs in the engine operation from a region other than said predetermined air-fuel ratio feedback control region to the latter region; and (4) immediately initiating the air-fuel ratio feedback control by the use of the corrected mean value of said coefficient as an initial value.

2. A method as claimed in claim 1, wherein said engine includes an exhaust gas purifying device comprising a three-way catalyst arranged in said exhaust pipe at a location downstream of said exhaust gas ingredient concentration detecting means, and the mean value of said coefficient is corrected by said predetermined value so that the resulting air-fuel ratio is richer than a theoretical air-fuel ratio at the start of the air-fuel ratio feedback control.

3. A method as claimed in claim 1, wherein said correcting of the mean value of said coefficient of said step (3) comprises multiplying the mean value of said coefficient by said predetermined value.

4. A method as claimed in claim 1, wherein said correcting of the mean value of said coefficient of said step (3) comprises adding said predetermined value to the mean value of said coefficient.

5. A method as claimed in claim 1, wherein said engine includes an exhaust gas purifying device comprising a three-way catalyst arranged in said exhaust pipe at a location downstream of said exhaust gas ingredient concentration detecting means, and the mean value of said coefficient is corrected by said predetermined value so that the resulting air-fuel ratio is leaner than a theoretical air-fuel ratio at the start of the air-fuel ratio feedback control.

* * * * *